US008002395B2

(12) United States Patent
Langford et al.

(10) Patent No.: US 8,002,395 B2
(45) Date of Patent: Aug. 23, 2011

(54) INK RECIRCULATION SYSTEM

(75) Inventors: Jeffrey D Langford, Lebanon, OR (US); Carrie E. Harris, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 589 days.

(21) Appl. No.: 12/218,302

(22) Filed: Jul. 14, 2008

(65) Prior Publication Data

US 2008/0273069 A1 Nov. 6, 2008

Related U.S. Application Data

(62) Division of application No. 11/062,043, filed on Feb. 18, 2005, now Pat. No. 7,416,293.

(51) Int. Cl.
*B41J 2/175* (2006.01)
*B41J 2/015* (2006.01)

(52) U.S. Cl. ..... 347/85; 347/21

(58) Field of Classification Search ..... 347/21, 347/28, 85, 87, 89
See application file for complete search history.

(56) References Cited

U.S. PATENT DOCUMENTS

| | | | | |
|---|---|---|---|---|
| 5,412,411 | A | 5/1995 | Anderson | |
| 5,418,557 | A * | 5/1995 | Pullen | 347/7 |
| 5,659,347 | A * | 8/1997 | Taylor | 347/85 |
| 5,936,650 | A | 8/1999 | Ouchida | |
| 6,145,954 | A | 11/2000 | Moore | |
| 6,302,516 | B1 | 10/2001 | Brooks | |
| 6,588,339 | B2 | 7/2003 | Naniwa | |
| 6,752,493 | B2 | 6/2004 | Dowell | |
| 6,899,410 | B2 | 5/2005 | Jeanmarie | |
| 6,984,029 | B2 | 1/2006 | Bellinger | |
| 7,198,351 | B2 | 4/2007 | Wang | |
| 7,331,664 | B2 * | 2/2008 | Langford et al. | 347/89 |
| 7,347,540 | B2 * | 3/2008 | Piock et al. | 347/85 |
| 7,556,367 | B2 * | 7/2009 | Langford et al. | 347/89 |

* cited by examiner

*Primary Examiner* — Anh T. N. Vo

(57) ABSTRACT

An ink recirculation system includes a printhead adapted for printing an ink image on a media, a printhead reservoir fluidly connected to the printhead, a pump, a valve fluidly connected to the pump and the printhead reservoir, and an ink supply container including cleaning fluid therein. The ink supply container is fluidly connected to the pump.

16 Claims, 2 Drawing Sheets

INK RECIRCULATION SYSTEM

This application is a divisional application of, and having the same inventors as, U.S. patent application Ser. No. 11/062,043, filed on Feb. 18, 2005, now U.S. Pat. No. 7,416, 293 and entitled INK RECIRCULATION SYSTEM.

BACKGROUND

Printing mechanisms may include a printhead for printing an image on a media. Ink retained within the printhead for long periods of time, such as during shipping and/or storage, may degrade the printhead. Purging the ink to a waste ink container prior to shipping or storage may be wasteful.

DETAILED DESCRIPTION OF THE DRAWINGS

Figure 1:
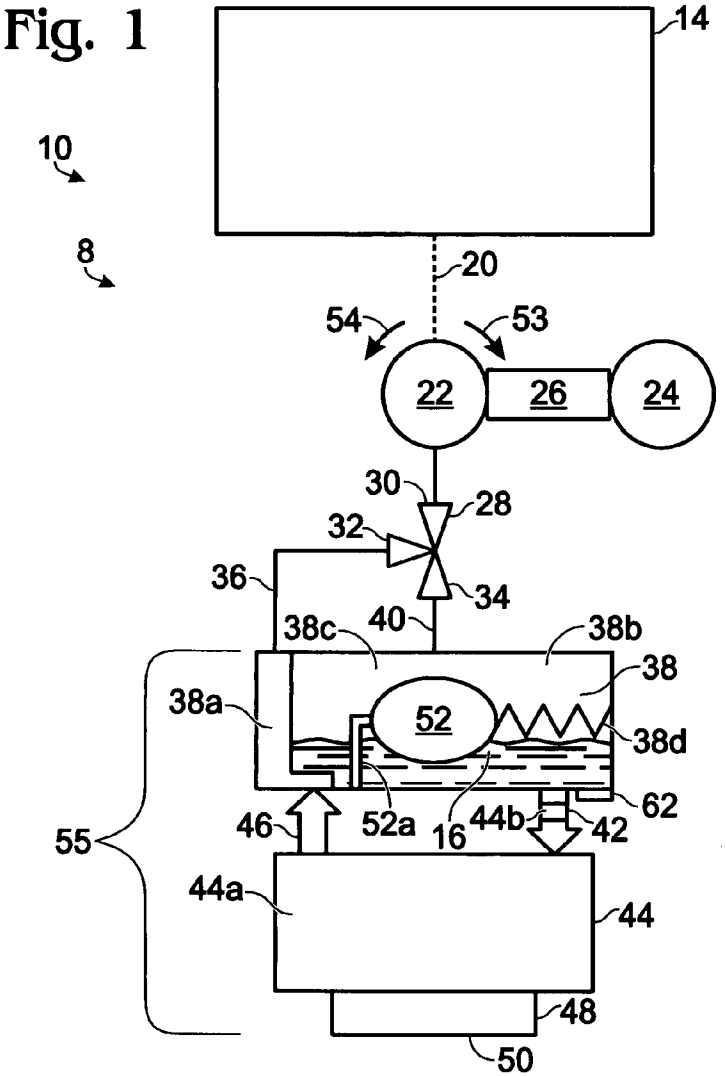
FIG. 1 is a schematic view of one embodiment of a printing mechanism that may include one embodiment of an ink recirculation system during an emptying routine.

FIG. 1 is a schematic view of one embodiment of a printing mechanism 8 that may include one embodiment of an ink recirculation system 10 during an emptying routine. Recirculation system 10 may include an ink supply container 14 that may be adapted to sequentially contain therein a printing fluid, such as inkjet ink 16 (see FIG. 2), and a cleaning fluid 18 (see FIG. 3), such as an ink-like, dye free solution, some mixture of water, surfactants, organic solvents, or the like. Ink supply container 14 may be positioned at a printhead of the system or may be positioned away from a printhead of the system, such that the ink supply container 14 may be referred to as an off-axis ink supply container. System 10 may further include a fluid line 20 that connects ink supply container 14 to a pump 22. Fluid line 20 is shown in dash lines because, in certain embodiments, ink supply container 14 may be removed from system 10 and replaced by a cleaning fluid container. The cleaning fluid container or depository may be the same size and shape as ink supply container 14 and, therefore, may also be indicated as reference number 14. Pump 22 may be connected to and operated by a motor 24. An ink sensor 26 may be operatively connected to pump 22 and/or motor 24 such that motor 24 may stop operating pump 22 upon sensor 26 indicating an out-of-ink condition in pump 22.

System 10 may further include a three-port valve 28 that may contain a first port 30, a second port 32, and a third port 34. Second port 32 may be connected to an outlet port 36, that may be connected to a snorkel or a standpipe 38*a*, also referred to as a vent region, of a printhead assembly 55. Third port 34 may be connected to an inlet port 40, which may be connected to a main fluid reservoir 38*b*, also referred to as an ink containing region, of ink reservoir 38, also referred to as a printhead reservoir, of printhead assembly 55. Printhead assembly 55 may further include a printhead inlet port 42 connected to a printhead 44 and a second printhead port 46 also connected to printhead 44. Accordingly, printhead 44 may be connected to two fluid connections 42 and 46. Printhead 44 may include a nozzle orifice plate 48 including nozzles 50 therein.

An emptying routine of printhead 44 will now be described. Valve 28 is first configured such that first port 30 is open, second port 32 is open and third port 34 is closed. Pump 22 is then operated in a first direction 53, for example, a forward or a clockwise direction. Such rotation of pump 22 may pull ink 16 from main fluid reservoir 38*b*, through printhead inlet port 42, printhead 44, printhead outlet port 46, through standpipe 38*a*, and through outlet port 36 of printhead assembly 55. In this manner, ink 16 is pumped through valve 28, pump 22, fluid line 20, and into ink supply container 14. This pumping action may continue until printhead assembly 55 is substantially emptied of ink 16 such that substantially all of ink 16 is contained in ink supply container 14. Pump 22 may be stopped when ink sensor 26 senses that no ink is flowing through the pump. All three ports of valve 28 may then be closed.

In this emptied or evacuated condition printhead 44 may contain substantially no ink therein. Accordingly, in this condition, printhead 44 and nozzle orifice plate 48 may be subjected to long periods of storage or transportation with limited contact with ink 16. Printhead 44 and nozzle orifice plate 48, therefore, may be subjected to limited degradation thereof by ink 16. For example, ink 16 may not be present so as to plug nozzles 50 or so as to degrade the adhesives, polymers, elastomers and/or metals in printhead 44 and ink reservoir 38 of printhead assembly 55.

Use of recirculation system 10, therefore, may allow printing mechanism 8 to be tested at the manufacture's site to ensure that all nozzles 50 are ejecting ink correctly. After testing, ink 16 may be emptied from ink printhead 44 to ink supply container 14 such that the ink is not discarded but is stored for future use and such that the ink does not degrade or limit the useful life of printhead 44. Additionally, use of recirculation system 10 may allow printhead assembly 55 to be used by a customer and thereafter emptied at the customer's site for storage or transport of the printer. The recirculation system 10 may, therefore, allow a customer to prepare and store a printer for long periods of time without a replacement printhead being utilized and without shipping the printer to a repair facility.

Figure 2:
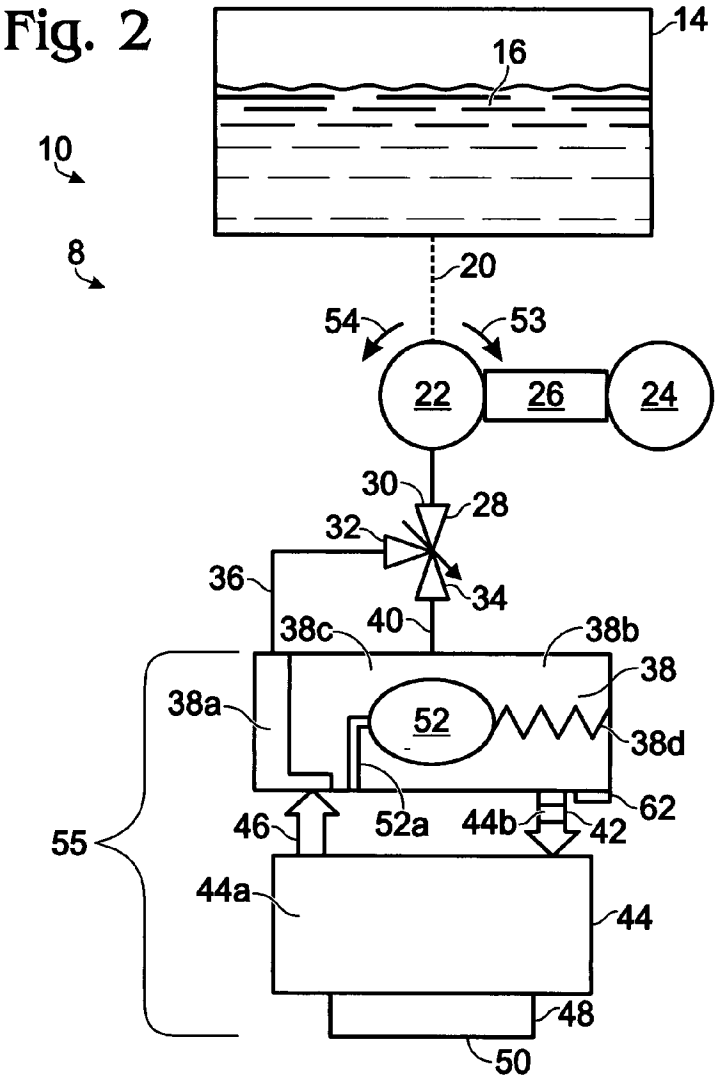
FIG. 2 is a schematic view of one embodiment of a printing mechanism that may include one embodiment of an ink recirculation system during shipping or storage.

FIG. 2 is a schematic view of one embodiment of printing mechanism 8 after the emptying routine of FIG. 1, showing ink 16 contained within ink supply container 14 and all three ports of valve 28 in the closed condition.

Figure 3:
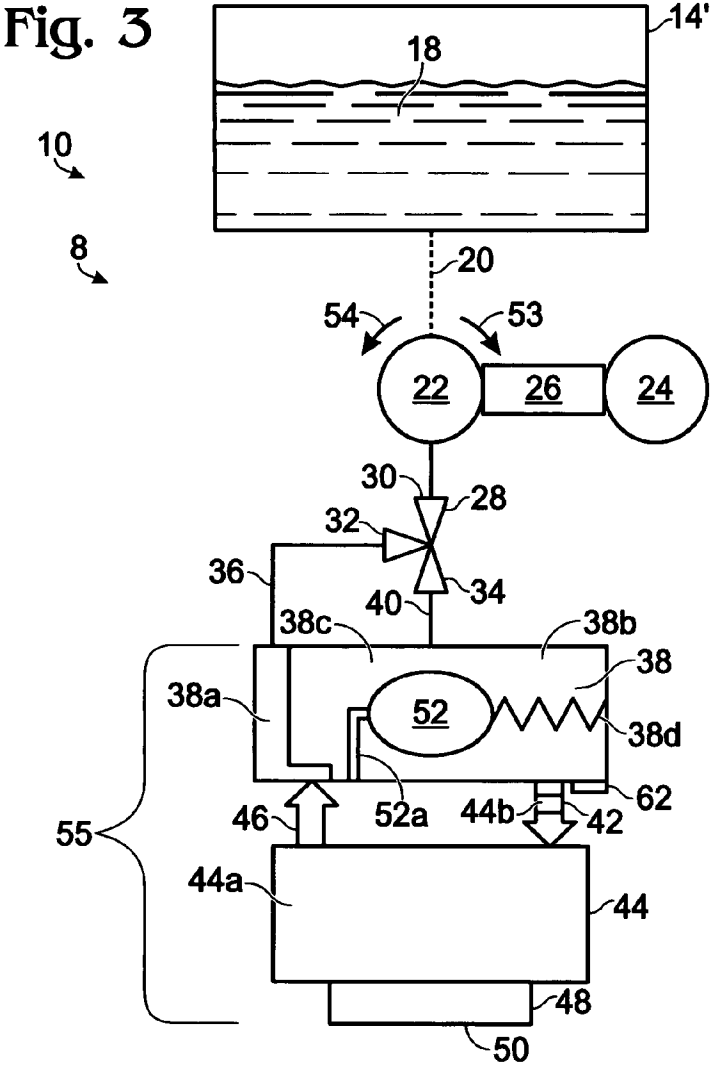
FIG. 3 is a schematic view of one embodiment of a printing mechanism that may include one embodiment of an ink recirculation system during a cleaning routine.

FIG. 3 is a schematic view of one embodiment of printing mechanism 8 that may include one embodiment of ink recirculation system 10 during a cleaning routine. During the cleaning routine, ink supply container 14 containing ink 16 (see FIG. 1) may be removed from ink delivery system 10 and set aside for future use. A new ink supply container 14', containing cleaning fluid 18 may then be connected to fluid line 20.

Valve 28 is then configured such that first port 30 and third port 34 are open and second port 32 is closed. Pump 22 is then operated in the first direction 53 to inflate a pressure regulation device, such as a bag 52, positioned within main fluid reservoir 38*b* by evacuating a volume 38*c* within main fluid reservoir 38*b* but exterior of bag 52.

Bag 52 may function by inflating or deflating so as to maintain a substantially consistent pressure within printhead 44. For example, bag 52 may inflate or deflate during temperature or pressure changes, such as due to altitude changes, outside printing mechanism 8. In this manner, pressure within main fluid reservoir 38*b* may be maintained so as to reduce fluctuations in the printing quality of printhead 44. In particular, bag 52 may include an air flow channel 52*a* in communication with ambient air outside main fluid reservoir 38*b*.

Here, as volume 38*c* inside main fluid reservoir 38*b* but exterior of bag 52 is evacuated, bag 52 will inflate in order to maintain a substantially constant pressure within main fluid reservoir 38*b*. When volume 38*c* inside main fluid reservoir 38*b* but exterior of bag 52 is later filled with a fluid/ink, bag 52 will deflate in order to maintain a substantially constant pressure within main fluid reservoir 38*b*. Deflation of bag 52 may be facilitated by a spring 38*d* positioned within main fluid reservoir 38*b*. Once bag 52 is completely inflated, and as pressure in volume 38*c* continues to decrease, air may begin to enter into reservoir 38 through a bubbler 62, also referred to as a bubble inlet port.

After inflation of bag 52, third port 34 of valve 28 is closed and first port 30 and second port 32 are opened, and then pump 22 is then operated in a second direction 54, which in the embodiment shown may be counterclockwise, to push cleaning fluid 18 from ink supply container 14' into ink reservoir 38 through second port 32. This process fills printhead 44 with cleaning fluid 18, In certain implementations, there may a filter 44*b* positioned between main fluid reservoir 38*b* and printhead 44, such as within first printhead port 42, such that when fluid is pumped into main fluid reservoir 38*b*, it will not flow into printhead 44 on it's own, it must be pumped or pulled. Filter 44*b* may include a very fine mesh that may not allow air to flow therethrough, but which will allow the passage of fluid therethrough when the fluid is pushed or pulled through the mesh.

In this example, cleaning fluid 18 is pushed by pump 22 through the loop of second port 32, outlet port 36, standpipe 38*a*, printhead 44, and into main fluid reservoir 38*b*.

After printhead 44 is filled with cleaning fluid 18, pump 22 may then be operated in first direction 53 to inflate pressure regulation bag 52 within main fluid reservoir 38*b* so as to set the fluid level within main fluid reservoir 38*b* to a desirable level. Valve 28 may then be closed.

To empty printhead 44 of cleaning fluid 18, first port 30 and second port 32 of valve 28 are opened and third port 34 is closed. Pump 22 may then be operated in first direction 53 to pull cleaning fluid 18 from ink reservoir 38, through port 42, printhead 44, outlet port 46, standpipe 38*a*, second port 36, first port 30, pump 22, and into ink supply container 14'. Ink sensor 26 may detect when air is flowing through pump 22 which may indicate that ink reservoir 38 and printhead 44 have been emptied of cleaning fluid 18. Valve 28 may then be closed. In this condition, substantially all of cleaning fluid 18 may be removed from ink reservoir 38 and printhead 44 such that only a residual amount of cleaning fluid 18 may remain in ink reservoir 38 and printhead 44. This cleaning cycle may be utilized to removed contaminates from ink reservoir 38 and printhead 44, such as ink sludge, accumulated solids, and the like.

This cleaning cycle may be repeated numerous times so as to flush printhead 44 with cleaning fluid 18. After cleaning is complete, cleaning fluid 18 may be removed from ink supply container 14'. In another embodiment, the container 14' containing cleaning fluid 18 may be removed from communication with fluid line 20 and another ink supply container 14 containing ink 16 may be placed in communication with fluid line 20. In another embodiment, both a cleaning fluid container and an ink supply container 14 may be in communication with fluid line 20 wherein each container is opened to fluid line 20 by operation of a valve (not shown). The cleaning cycle may be conducted within a short period of time after the emptying routine, such as immediately after the emptying routine, so that bubbler 62 does not dry out after emptying and before cleaning. If a large period of time will elapse between cleaning and emptying, bubbler 62 may be capped with cap 60.

Figure 4:
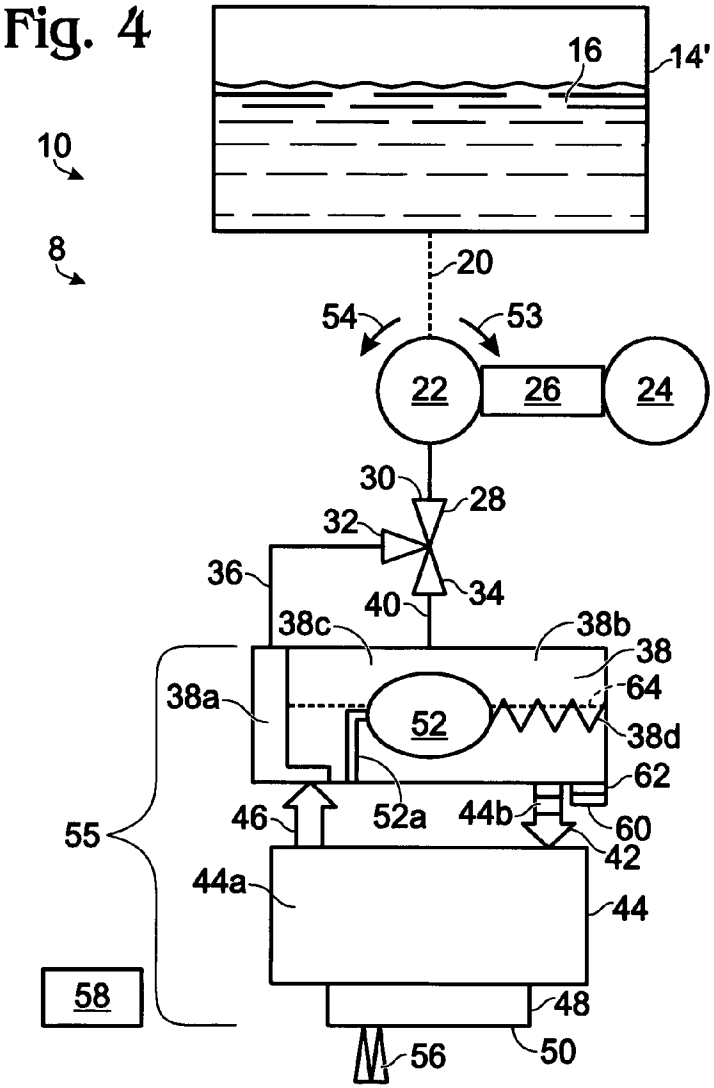
FIG. 4 is a schematic view of one embodiment of a printing mechanism that may include one embodiment of an ink recirculation system during a filling routine.

FIG. 4 is a schematic view of one embodiment of printing mechanism 8 that may include one embodiment of an ink recirculation system 10 during a filling or start-up routine. First, a wiper 56 may be moved into contact with a sealing material 58, such as di-propylene glycol, such that sealing material 58 may be positioned on wiper 56. Wiper 56 may then be wiped across nozzle orifice plate 48, to place sealing material 58 thereon, and so as to seal nozzles 50.

A bubbler cap 60 may then be moved into a capping position on bubbler 62 of ink reservoir 38. In one embodiment, bubbler 62 may include a wire mesh that may allow air bubbles to move into ink reservoir 38 so as to replace a volume of air within ink reservoir 38 as printhead 44 fires ink droplets therefrom. Bubbler cap 60 may include a rubber cap that seals around a circumference of bubbler 62 to define an air-tight seal therearound.

Valve 28 may then be moved to a position such that first port 30 is open, second port 32 is closed and third port 34 is open. Pump 22 may then be operated in first direction 53 to inflate pressure regulation bag 52 by removing volume from reservoir 38. After bag 52 is inflated, pump 22 may then be operated in second direction 54 to push ink 16 from ink supply container 14 into ink reservoir 38. When ink reservoir 38 is full of ink 16, pump 22 may be operated in first direction 53 so as to set fluid level 64 within reservoir 38 by inflating pressure regulation bag 52. Valve 28 may then be closed.

Valve 28 may then be positioned such that first port 30 is open, second port 32 is open and third port 34 is closed. Pump 22 may be operated in first direction 53 for a short duration to pump an amount of air and ink from printhead 44 to completely remove air from printhead inlet 42, printhead 44 and printhead outlet 46, such as removing approximately a range of 0.5 to 1.0 cubic centimeters of air. Next, port 32 is closed and port 34 is opened. Pump 22 is operated in second direction 54 so as to pump the air and ink that was removed from printhead 44 back into reservoir 38. Finally, pump 22 may be operated in first direction 53 so as to re-inflate bag 52 and set the ink level and backpressure. In this manner, printhead 44 is filled with ink, pressurized to a predetermined pressure, and thereby readied for printing.

Other variations and modifications of the concepts described herein may be utilized and fall within the scope of the claims below.

We claim:

1. An ink recirculation system, comprising:

a printhead adapted for printing an ink image on a media;

a printhead reservoir connected to said printhead;

a pump;

a valve connected to said pump and said printhead reservoir; and an ink supply container including cleaning fluid therein, said ink supply container connected to said pump;

wherein the pump is operable to pump the cleaning fluid from the ink supply container to the printhead through the valve and the printhead reservoir.

2. A system according to claim 1 wherein said valve includes a three port valve.

3. A system according to claim 1 wherein said printhead reservoir includes a vent region and an ink containing region, and wherein said valve is connected to said vent region and said ink containing region.

4. A system according to claim 1 wherein said printhead reservoir is fluidly connected to said printhead at two fluid connections.

5. A system according to claim 1 wherein said pump is adapted for pumping said cleaning fluid through said printhead.

6. A printer, comprising:

a pump;

an ink reservoir including an inlet port and an outlet port;

a three-port valve connected to said pump, said inlet port of the ink reservoir, and said outlet port of the ink reservoir; and an ink supply container connected to said pump and adapted for sequentially containing printing fluid and cleaning fluid therein;

wherein the pump is operable to pump the fluid from the ink supply container through the three-port valve to the inlet port of the ink reservoir.

7. A printer according to claim 6 further comprising a motor operatively connected to and powering said pump.

8. A printer according to claim 6 further comprising a printhead connected to said ink reservoir.

9. A printer according to claim 6 wherein said pump is adapted for operating in a first direction to remove fluid from said ink reservoir and in a second direction to pump fluid to said ink reservoir.

10. A printer according to claim 9 wherein said pump operating in said first direction pumps fluid to said ink supply container and said pump operating in said second direction pumps fluid from said ink supply container.

11. A printing apparatus, comprising:

means for directing fluid, said means containing first, second and third fluid ports;

means for pumping fluid in a first direction and in a second direction opposite said first direction, said means for pumping connected to said first fluid port;

means for printing an image including an inlet port connected to said second fluid port and an outlet port connected to said third fluid port; and means for storing fluid therein, said means for storing connected to said means for pumping and adapted for sequentially storing therein printing fluid and cleaning fluid;

wherein the means for pumping is operable to pump the fluid from the means for storing through the means for directing and the means for printing.

12. An apparatus according to claim 11 wherein said means for printing an image includes a printhead connected to an ink reservoir, said ink reservoir including said inlet port and said outlet port.

13. An apparatus according to claim 12 wherein said ink reservoir includes a bubble inlet port, said apparatus further comprising a bubble inlet port cap adapted for moving into an out of capping engagement with said bubble inlet port.

14. An apparatus according to claim 11 wherein said means for directing includes a three-port valve that may be moved between a first position that directs fluid flow through said first port and said second port, a second position that directs fluid flow through said first port and said third port, and a third position wherein fluid is stopped from flowing though said valve.

15. An apparatus according to claim 11 wherein said means for storing fluid includes an off-axis ink supply container.

16. An apparatus according to claim 1 wherein said outlet port of said ink reservoir includes a standpipe.

* * * * *

UNITED STATES PATENT AND TRADEMARK OFFICE

CERTIFICATE OF CORRECTION

PATENT NO. : 8,002,395 B2
APPLICATION NO. : 12/218302
DATED : August 23, 2011
INVENTOR(S) : Jeffrey D Langford et al.

It is certified that error appears in the above-identified patent and that said Letters Patent is hereby corrected as shown below:

In column 6, line 31, in Claim 16, delete "claim 1" and insert -- claim 11 --, therefor.

Signed and Sealed this
Tenth Day of April, 2012

David J. Kappos

David J. Kappos
*Director of the United States Patent and Trademark Office*